US006139976A

United States Patent [19]

Czech et al.

[11] Patent Number: 6,139,976

[45] Date of Patent: Oct. 31, 2000

[54] ARTICLE HAVING A SUPERALLOY SUBSTRATE AND AN ENRICHMENT LAYER PLACED THEREON, AND METHODS OF ITS MANUFACTURING

[75] Inventors: Norbert Czech, Dorsten; Knut Halberstadt, Mülheim an der Ruhr, both of Germany; John Smith, Welwyn Garden City; Adrian Kempster, Redebourn L, both of United Kingdom

[73] Assignee: Siemens Aktiengesellschaft, Munich, Germany

[21] Appl. No.: 09/327,008

[22] Filed: Jun. 7, 1999

Related U.S. Application Data

[63] Continuation of application No. PCT/EP97/06719, Dec. 1, 1997.

[30] Foreign Application Priority Data

Dec. 6, 1996 [EP] European Pat. Off. ..... 96 308 870

[51] Int. Cl.[7] ..... B32B 5/14; C23C 16/00; F02C 1/00

[52] U.S. Cl. ..... 428/610; 148/516; 148/537; 148/425; 148/428; 148/240; 416/241 R; 416/241 B; 416/232; 427/250; 427/256; 427/269; 427/376.8; 427/419.2; 428/630; 428/632; 428/637; 428/642; 428/472.2; 428/652; 428/667; 428/678; 428/680; 428/938; 428/941

[58] Field of Search ..... 428/610, 630, 428/632, 637, 642, 472.2, 652, 667, 678, 680, 938, 941; 148/516, 537, 425, 428, 240; 427/250, 256, 269, 419.2, 376.8; 416/241 R, 241 B, 232

[56] References Cited

U.S. PATENT DOCUMENTS

| | | | |
|---|---|---|---|
| 4,929,473 | 5/1990 | Marquez et al. | 428/651 |
| 5,262,245 | 11/1993 | Ulion et al. | 428/472.2 |
| 5,292,594 | 3/1994 | Liburdi et al. | 428/941 |
| 5,401,307 | 3/1995 | Czech et al. | 106/14.05 |
| 5,499,905 | 3/1996 | Schmitz et al. | 428/667 |
| 5,543,183 | 8/1996 | Streckert et al. | 427/250 |
| 5,882,439 | 3/1999 | Nakahama et al. | 428/610 |

FOREIGN PATENT DOCUMENTS

| | | |
|---|---|---|
| 0 587 341 A1 | 3/1994 | European Pat. Off. . |
| 2 403 312 | 8/1974 | Germany . |
| 42 22 026 C1 | 4/1993 | Germany . |

OTHER PUBLICATIONS

International Publication No. WO 93/03201, Feb. 18, 1993.
International Publication No. WO 96/34130, Oct. 31, 1996.
Super alloys II, Sims, et al., (eds); New York: Wiley–Interscience, 1986; pp. 97–162, 189–214, and 549–561, no month.

*Primary Examiner*—John J. Zimmerman
*Assistant Examiner*—Robert R. Koehler
*Attorney, Agent, or Firm*—Herbert L. Lerner; Laurence A. Greenberg; Werner H. Stemer

[57] ABSTRACT

The invention relates to an article of manufacture comprising: a substrate composed of a superalloy containing chromium and a base element selected from the group consisting of iron, cobalt, and nickel; and an enrichment layer containing chromium and placed on the substrate. Therein, the enrichment layer comprises a continuous matrix composed of a gamma-phase solid solution of chromium in the base element. The invention also relates to the manufacture of such an article. The article may in particular be a gas turbine component.

32 Claims, No Drawings

ARTICLE HAVING A SUPERALLOY SUBSTRATE AND AN ENRICHMENT LAYER PLACED THEREON, AND METHODS OF ITS MANUFACTURING

CROSS-REFERENCE TO RELATED APPLICATION

This application is a continuation of copending International application No. PCT/EP97/06719, filed Dec. 1, 1997, which designated the United States.

BACKGROUND OF THE INVENTION

1. Field of the Invention

The invention relates to an article of manufacture comprising: a substrate composed of a superalloy containing chromium and a base element selected from the group consisting of iron, cobalt, and nickel; and an enrichment layer containing chromium and placed on the substrate.

The invention also relates to a method of manufacturing an article comprising: a substrate composed of a superalloy containing chromium and a base element selected from the group consisting of iron, cobalt, and nickel; and an enrichment layer containing chromium and placed on the substrate; wherein the enrichment layer is placed by precipitating chromium onto the substrate and diffusing precipitated chromium into the substrate to form the enrichment layer.

The invention further relates to a method of manufacturing an article comprising a substrate composed of a superalloy containing chromium, a base element selected from the group consisting of iron, cobalt, and nickel, and a combining element which forms a gamma-prime phase intermetallic compound with the base element and an oxide scale as subjected to an oxidizing condition at a high temperature; and an enrichment layer containing chromium and placed on the substrate; wherein the enrichment layer is placed by precipitating chromium onto the substrate, diffusing precipitated chromium into the substrate to form the enrichment layer and diffusing the combining element from the substrate into the enrichment layer.

2. Description of the Pertinent Art

An article of this type and methods of these types are apparent from the book "Superalloy II", edited by C. T. Sims, N. S. Stoloff and W. C. Hagel, John Wiley & Sons, New York 1987. Of particular relevance in this context are chapter 4 "Nickel-Base Alloys", pages 97 ff., chapter 5 "Cobalt-Base Alloys", pages 137 ff., and chapter 13 "Protective Coatings", pages 359 ff.

The book also contains an extensive survey of the whole technical field of nickel-base and cobalt-base superalloys, their manufacture, and their application in heat engines, in particular stationary and mobile gas turbines.

U.S. Pat. No. 5,499,905 relates to a metallic component of a gas turbine installation having protective coating layers, wherein the component is formed of a nickel-base base material and at least two coating layers, which coating layers are optimized to resist corrosive attacks within specified temperature ranges. The coating layers may include an inner layer in the form of a diffusion layer formed by diffusing chromium into the base material. Another coating layer formed of an alloy of the type MCrAlY, composed of a metal M selected from iron, cobalt, and nickel, further chromium, aluminum and yttrium or another rare earth metal. Further ingredients, including rhenium, may also be present.

WO 93/03201 A1 relates to the refurbishing of corroded superalloy or heat resistant steel parts and parts so refurbished. During the refurbishing, corroded superalloy or heat resistant steel parts like gas turbine components are stripped of products of corrosion and damaged protective coatings eventually present, and may be provided with new protective coatings. Such a protective coating can be formed by diffusing chromium into the refurbished part, or by applying an MCrAlY-type alloy, inter alia.

U.S. Pat. No. 5,401,307 relates to a high temperature-resistant corrosion protective coating on a component, in particular a gas turbine component. The component is in particular formed of a nickel-base of cobalt-base superalloy, and the corrosion protective coating is composed of a specially developed MCrAlY-type alloy. That alloy is also very suitable to bond a ceramic thermal barrier layer to the component.

In this context, U.S. Pat. No. 5,262,245 describes an effort to modify a nickel-base superalloy to make it suitable to anchor a ceramic thermal barrier layer directly on a thin, adherent alumina scale formed on the superalloy.

Meanwhile, modifications to MCrAlY-type alloys and superalloys have been proposed which include replacing aluminum partly or wholly by gallium. In this respect, it is expected that gallium retains corrosion-protective and structurally relevant features of aluminum but avoids an embrittlement which must be expected if the proportion of aluminum in a respective alloy is increased.

WO 96/34130 A1 concerns a superalloy article which is hollow and thereby has an outer side to be exposed to a hot flue gas during service and an inner side to be exposed to a cooling gas like compressed air or steam. To provide oxidation and corrosion resistant properties for the inner side of the article, the inner side has an aluminide coating. This aluminide coating is made by precipitating aluminum onto the inner side and diffusing the aluminum into the superalloy. In that context, it will not generally be possible to avoid a concurrent precipitation of aluminum onto the outer side of the article, which outer side is subsequently to be provided with another protective coating. To avoid problems which might result from the embrittling property of the aluminum on the outer side of the article, a special manufacturing method as well as an article so manufactured are shown.

A nickel-base superalloy can be characterized in general terms to comprise a continuous matrix composed of a gamma-phase solid solution of chromium in nickel and a precipitate granularly dispersed in and coherent with the matrix and composed of a gamma-prime-phase intermetallic compound formed of nickel and aluminum and/or titanium. In the following text, elements like aluminum and titanium are termed "combining elements". To specify the precipitate as coherent with the matrix means that crystalline structures of the matrix are continued into the grains of the precipitate.

Thus, there are generally no cuts or cleavages between the matrix and the grains of the precipitate. Instead, an interface between the matrix and the grain of the precipitate is characterized by a local change in chemical composition through a continuous, however strained, crystal lattice. Further precipitates generally not coherent with the matrix may also be present. These further precipitates include carbides and borides. Also, additional elements are generally present in the superalloy, and these elements must be expected to be distributed in the matrix as well as in the precipitate. These additional elements may comprise elements which have a particular high affinity to form the said further precipitates like carbides and borides. Elements of this type are niobium, tungsten, hafnium and zirconium.

A cobalt-base superalloy can be characterized in general terms to comprise a continuous matrix composed of a gamma-phase solid solution of chromium in cobalt. This continuous matrix can generally be strengthened by various alloying elements, and precipitates granularly dispersed in the matrix and formed of compounds like carbides and borides can generally be present as well. In contrast to nickel, however, cobalt does not form a gamma-prime phase compound with aluminum or titanium which could serve as a principal strengthening component. As compared to nickel-base superalloys, cobalt-base superalloys are generally inferior with regard to strength; but cobalt-base superalloys are superior as regards thermal stability. Accordingly, both nickel-base alloys and cobalt-base alloys are applied in gas turbine industry. In general, nickel-base alloys are utilized for highly stressed moving components like first-stage gas turbine blades, whereas cobalt-base superalloys are utilized for components under extreme thermal but moderate mechanical stress like first-stage gas turbine vanes.

Recent efforts to improve creep rupture properties of nickel-base superalloys have resulted in alloys wherein the proportion of the intermetallic precipitate amounts up to 50% in parts by volume and even more. Thereby, these alloys have superior creep properties at temperatures above 750° C. However, an increase of the proportion of the intermetallic precipitate must be met by a decrease of the amount of chromium in the superalloy, since chromium is predominantly concentrated in the matrix and hardly stored in the precipitate. However, chromium is a major promoter of oxidation and corrosion resistance of the superalloy, as chromium shows an effect of promoting diffusion of aluminum, and presumably also gallium, to form an aluminum or gallium oxide scale on the superalloy under suitable conditions. Accordingly, a reduction of chromium in a superalloy must generally be expected to be followed by a decrease in corrosion and oxidation resistance, which contravenes of course pertinent interests, even if only to avoid immediate failure of a superalloy component if its protective coating has received some kind of damage.

In cobalt-base superalloys, the strengthening effect obtained by forming a coherent precipitate of a gamma-prime compound is much less pronounced than in nickel-base superalloys. Cobalt-base superalloys generally rely on solid solution strengthening effects obtained by alloying elements which form a gamma phase solid solution with cobalt. Additionally, non-coherent precipitates like carbides and borides may be utilized. However, it may be advantageous to form precipitates of intermetallic compounds formed with aluminum, in particular, even if only to utilize the corrosion and oxidation protective properties of aluminum, as explained for nickel-base superalloys. With regard to these properties, the element chromium, which is generally present in a cobalt-base superalloy, also plays a promotive role, as explained for nickel-base superalloys. Much as for nickel-base superalloys, it might be desirable to keep the chromium content of a cobalt-base superalloy predominantly low in order to obtain certain benefits with regard to structural properties and yet retain oxidation and corrosion resistant properties which usually require a chromium content above a certain limit.

A diffused chromium-containing layer on a superalloy substrate may be termed "enrichment layer" as characterized by an enrichment of chromium. Such a diffused layer can generally have a concentration gradient of chromium increasing from a minimum value substantially equal to a concentration of chromium in the substrate at an interface between the substrate and the enrichment layer to a maximum value greater than the minimum value at a surface of the enrichment layer facing away from the substrate. This is of course due to the diffusion process itself used to form the layer. The enrichment layer generally has a predominantly high concentration of chromium at its outer surface. Thereby, so-called alpha-phase chromium compounds which are characterized by a body-centered cubic crystal structure occur at least at and/or near the surface. If exposed to an oxidizing condition at a sufficiently high temperature, the enrichment layer is expected to form a chromium oxide scale on its surface, which scale is expected to suppress any further oxidation of the enrichment layer or the substrate. If aluminum or another combining element is present in the enrichment layer, it may be expected to be stored in beta-phase compounds like NiAl. From these compounds, the combining element may diffuse to the surface of the enrichment layer and form an oxide scale of its own oxide in addition to, or in replacement of, the chromium oxide scale under suitable conditions.

In practice, it has been observed that chromium-containing layers formed on superalloy articles are prone to rapid degradation if exposed to oxidizing and corrosive conditions as occur during usual service. Accordingly, aluminide layers formed by diffusing aluminum into superalloy articles have attained a widespread use for protective purposes, while accepting the brittleness of the aluminides usually formed. The major problem however eventually resulting from the brittleness is a tendency for cracking under mechanical load.

SUMMARY OF THE INVENTION

Accordingly, it is an object of the invention to provide an improved article of manufacture comprising a substrate composed of a superalloy, which allows the corrosion and oxidation protective potential of chromium to be more fully exploited. It is also an object of the invention to provide methods to manufacture such an article.

With the above mentioned and other objects in view, there is provided, in accordance with the invention, an article of manufacture comprising

- a substrate composed of a superalloy containing chromium and a base element selected from the group consisting of iron, cobalt, and nickel; and
- an enrichment layer containing chromium and placed on the substrate; wherein
- the enrichment layer comprises a continuous matrix composed of a gamma-phase solid solution of chromium in the base element.

In accordance with the invention, a specifically composed enrichment layer is provided on the superalloy substrate. The composition of the enrichment layer is carefully balanced to enable this enrichment layer to form a stable oxide scale when exposed to an oxidizing condition at a high temperature.

To this end, no essential amounts of alpha-phase chromium compounds is present to avoid rapid degradation of the enrichment layer when it is ubjected to corrosive and oxidative attack. This is accomplished by providing the enrichment layer with a continuous matrix composed of a gamma-phase solid solution of chromium in the base element. This solid solution is expediently formed by diluting the superalloy of the substrate with chromium, for example in the context of a diffusion process. As this dilution is carefully controlled, it is assured that a phase transition within the substrate which transforms into the enrichment layer and leading to formation of alpha-phase chromium compounds is substantially avoided and the gamma-phase solid solution retained. If no alloying elements are present and the base element is nickel, this gamma-phase solid solution will be stable up to a chromium content of about 75% by weight.

The enrichment layer according to the invention can act as a protective coating; however, a specialized protective coating placed upon the enrichment layer will frequently be preferred. A major purpose of the enrichment layer is to afford properties of superalloys having high chromium content to a superalloy which is particularly low in chromium. These properties may not be sufficient to use the inventive article in a gas turbine application without further protective means, but they are sufficient to give enough protection to avoid immediate failure of the article if specialized protective means like special dedicated coatings are lost.

Other features which are considered as characteristic for the invention are set forth in the appended claims.

Although the invention is illustrated and described herein as embodied in an article having a superalloy substrate and an enrichment layer placed thereon, and methods of its manufacturing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

DESCRIPTION OF THE PREFERRED EMBODIMENTS

In accordance with a preferred embodiment of the invention, the base element is nickel. The superalloy is therefore a nickel-base superalloy according to usual terminology. By application of the invention, the nickel-base superalloy has a remarkably high potential for strengthening by increasing the proportion of the gamma-prime phase precipitate, which is normally accomplished by reducing the chromium content. That is now possible without compromising the oxidation and corrosion resistant properties of the alloy, since these properties are comprehensively provided by the enrichment layer formed in accordance with the invention. The nickel-base superalloy can also additionally contain cobalt.

In accordance with a particularly preferred embodiment of the invention, the nickel-base superalloy contains a combining element which forms a gamma-prime phase intermetallic compound with nickel and an oxide scale as subjected to an oxidizing condition at a high temperature; and the enrichment layer comprises a precipitate granularly dispersed in the matrix and composed of a beta-phase intermetallic compound of nickel and the combining element. More preferably, the combining element is selected from the group consisting of aluminum and gallium. According to these embodiments, the combining element is utilized both to provide the strengthening gamma-prime phase precipitate in the superalloy itself and to provide an oxide scale on the enrichment layer if the enrichment layer is subjected to an oxidizing condition and a suitable temperature. To this end, the combining element is stored in the enrichment layer in the form of a beta-phase intermetallic compound like NiAl and NiGa. As no efficient amount of alpha-phase chromium compound is present in the enrichment layer, the enrichment layer will not form a chromium oxide layer under suitable oxidizing conditions, but instead an oxide layer consisting essentially of oxides of the combining element or the combining elements, if several are present, will be developed. Thereby, the superior oxidation and corrosion resistant properties of alumina and gallium oxide, as compared to chromium oxide, can be utilized.

In accordance with a particularly preferred embodiment of the invention, the nickel-base superalloy contains chromium with a concentration of less than 14% by weight, in particular less than 10% by weight. Thereby, the nickel-base superalloy has the best structural properties, as already explained. For that superalloy, the invention unites both the superior structural properties of low-chromium superalloys and the superior oxidation and corrosion resistant properties of high-chromium superalloys.

In accordance with another embodiment of the invention, the enrichment layer comprises a further precipitate granularly dispersed in the matrix and composed of a gamma-prime phase compound of nickel and the combining element. In this respect, it is recalled that such gamma-prime phase compounds play a specified role in known nickel-base superalloys. These gamma-prime phase compounds can also form in the enrichment layer according to the invention, for example if this enrichment layer is subjected to suitable elevated temperatures as may occur during intended service of the article. Such gamma-prime phase compounds can also serve as a reservoir for the combining element to provide an oxide scale of this combining element on the enrichment layer for corrosion and oxidation protective purposes.

As an alternative to the embodiments just mentioned, the base element of the inventive article can also be cobalt.

In accordance with a further embodiment of the invention, the enrichment layer has a concentration gradient of chromium increasing from a minimum value substantially equal to a concentration of chromium in the superalloy at an interface between the substrate and the enrichment layer to a maximum value greater than the minimum value at a surface of the enrichment layer facing away from the substrate. This embodiment lends itself particularly to creating the enrichment layer by diffusing chromium into the substrate. In this respect, a diffusion process like vapor deposition and pack chromizing can be applied.

In accordance with a further preferred embodiment of the invention, the maximum value of the concentration gradient of chromium in the enrichment layer is less than 45% by weight. Thereby, there is no substantial formation of alpha-phase chromium compounds in the enrichment layer and the desired structure with a gamma-phase matrix is produced.

It is generally preferred that the enrichment layer is essentially free of alpha-phase chromium compounds, for the reasons already given.

In accordance with yet a further embodiment of the invention, the article has a protective coating placed on the enrichment layer. The protective coating can comprise a ceramic thermal barrier layer, and it may also comprise a layer composed of an MCrAlY alloy. Thereby, the enrichment layer is only used as an auxiliary protective means, to become active if a specially provided protective means like the said protective coating is lost by some kind of damage. In this respect, it should be noted that by providing an additional protective coating, design of the enrichment layer can more effectively take into account considerations of mechanical compatibility between the substrate itself and the enrichment layer, so as to avoid the occurrence of undue strains between the enrichment layer and the substrate and have the enrichment layer tailored to pertinent requirements with respect to the substrate.

In accordance with a particularly preferred embodiment of the invention, the substrate is a hollow body having an inner side and an outer side and is covered by the enrichment layer both on the inner side and on the outer side. Particularly in that context, the substrate can be a gas turbine component. The substrate may be formed as a hollow body to carry a cooling medium, as is usual in gas turbine practice. In this context, the enrichment layer on the inner side of the substrate can act as a sole protective layer. Naturally, a thermal stress on the inner surface of a hollow body cooled from the inside is not very high. Thus, the enrichment layer may be sufficient to suitably protect the inner side against corrosion and oxidation, whereas the outer side is preferably provided with a specialized protective coating placed on the enrichment layer. Such embodiments are considered to be of particular relevance if a nickel-base superalloy with a particularly low chromium content is used, as explained in particular for nickel-base superalloys tailored to have superior structural properties.

In accordance with another particularly preferred embodiment of the invention, the substrate is a hollow body having an inner side and an outer side and the substrate is covered by the enrichment layer only on the inner side. This embodiment is deemed to be relevant for a particularly great class of superalloys including cobalt-base superalloys, and also for gas turbine practice as explained in the preceding paragraph. Thereby, the invention is utilized to provide cooling channels formed within the substrate and bounded by the inner side of the article with improved oxidation and corrosion resistant properties by locally increasing the chromium content of the article. This may be relevant even if the oxidation and corrosion resistant properties of the superalloy itself are regarded as sufficient for the case that dedicated protective systems fail. A particularly preferred development of this embodiment is characterized by a protective coating covering the outer side of the article and placed directly on the substrate.

With the herein-above specified and other objects in view, there is also specified, in accordance with the invention, a method of manufacturing an article comprising: a substrate composed of a superalloy containing chromium and a base element selected from the group consisting of iron, cobalt, and nickel; and an enrichment layer containing chromium and placed on the substrate; wherein: the enrichment layer is placed by precipitating chromium onto the substrate and diffusing precipitated chromium into the substrate to form the enrichment layer; the method wherein the precipitated chromium is diffused into the substrate to form the enrichment layer having a continuous matrix composed of a gamma-phase solid solution of chromium in the base element.

Many advantages and applications of this method and the article manufactured therewith will apparent to one skilled in the art from the above specification of the inventive article and the method for its manufacture.

Preferably, the superalloy contains cobalt as the base element. Also preferably, the substrate is a hollow body having an inner side and an outer side; and the enrichment layer is placed on the substrate only on the inner side. Further preferably, the outer side is covered with a protective coating placed on the substrate.

With the herein-above specified and other objects in view, there is also specified, in accordance with the invention, a method of manufacturing an article comprising: a substrate composed of a superalloy containing chromium, a base element selected from the group consisting of iron, cobalt, and nickel, and a combining element which forms a gamma-prime phase intermetallic compound with the base element and an oxide scale as subjected to oxygen at a high temperature; and an enrichment layer containing chromium and placed on the substrate; wherein: the enrichment layer is placed by precipitating chromium onto the substrate, diffusing precipitated chromium into the substrate to form the enrichment layer and diffusing the combining element from the substrate into the enrichment layer; and wherein: precipitated chromium is diffused into the substrate to form a matrix composed of a gamma-phase solid solution of chromium in the base element; and the combining element is diffused into the enrichment layer to form a precipitate granularly dispersed in the matrix and composed of a beta-phase intermetallic compound of the combining element and the base element.

Many advantages and applications of this method and the article manufactured therewith will apparent to one skilled in the art from the above specification of the inventive article and the method for its manufacture.

The inventive method is a special development of a well-known process called "chromizing" by carefully controlling the supply of chromium to the substrate so as to avoid formation of alpha-phase chromium compound.

Such an alpha-phase chromium compound is characterized by a body-centered cubic crystal structure and tends to form a scale of chromium oxide under suitable conditions. However, the corrosion resistant and oxidation resistant properties of chromium oxide are generally inferior to the respective properties of combining elements like aluminum and gallium, and accordingly formation of alpha-phase chromium compounds is to be avoided.

In accordance with a preferred mode of the invention, the substrate contains nickel as the base element. More preferably, the substrate contains chromium, with a concentration of chromium of less than 14% by weight, in particular of less than 10% by weight. This mode corresponds to certain preferred embodiments of the inventive article. All explanations given in that respect also apply here and are incorporated here by reference.

In accordance with another preferred mode of the invention, the substrate is a hollow body having an inner side and an outer side, and the enrichment layer is placed on the substrate both on the inner side and on the outer side. Subsequently, the outer side may be covered with a protective coating placed on the enrichment layer.

In accordance with a further mode of the invention, the combining element is diffused into the enrichment layer by a heat treatment step subsequent to forming the enrichment layer. More preferably, that heat treatment step is a heat treatment required to accomplish the step of diffusing the precipitated chromium into the substrate or to afford certain desired properties to the superalloy in the substrate.

In accordance with yet another preferred mode of the invention, the enrichment layer is formed having a concentration gradient of chromium increasing from a minimum value substantially equal to a concentration of chromium in the superalloy at an interface between the substrate and the enrichment layer to a maximum value greater than the minimum value at a surface of the enrichment layer facing away from the substrate.

In accordance with a concomitant preferred mode of the invention, the chromium is precipitated onto the substrate by forming a vapor comprising chromium distant from the substrate, guiding the vapor to the substrate and precipitating chromium onto on the substrate from the vapor. This preferred mode of the invention requires a vapor deposition process different from the well-known pack chromizing process and allows one to utilize the special properties of that vapor deposition process to control the precipitation of chromium onto the substrate. It has already been explained that a careful control of the process of precipitating the chromium is necessary to avoid formation of undesired chromium compounds, and the vapor deposition process is seen to offer more possibilities for control than the usual pack chromizing process. In the pack chromizing process, an article to be chromized is generally immersed in a powdery preparation which releases chromium vapor under suitably high temperatures. Thereby, rapid deposition of chromium is offered, however the possibilities to control the precipitation of chromium onto the article are fairly poor. However, it is not intended to exclude pack chromizing processes from the scope of the invention.

Particularly preferred examples to actually use the invention are now explained.

EXAMPLE 1

The article to be manufactured is a gas turbine component, in particular a gas turbine blade. A substrate for this article is shaped of a commercially available nickel-base superalloy specified as CMSX-4. This superalloy contains chromium at about 6% by weight and aluminum as the combining element and is characterized by a superior creep rupture strength at high temperatures. Without reference to possible damage by oxidation or corrosion, the superalloy can be used at a temperature up to 950° C. However, owing to a particularly low resistance to corrosion and oxidation, that temperature cannot be realized when actually using the superalloy; practically, the thermal load of this superalloy must be limited to about 875° C. Thereby, the superalloy CMSX-4 has hardly any practical advantage over superalloys like GTD 111, IN 738 and IN 6203, which have higher chromium contents and are thus better in corrosion and oxidation resistance, however not as strong as CMSX-4.

Accordingly, the CMSX-4 substrate, which is structured as a single crystal by a usual directional solidification technique as prescribed by the supplier, is provided with an enrichment layer by adding an efficient amount of chromium at least to the surface of the substrate, while the advantageous structure of the bulk of the substrate which requires a fairly low chromium content is retained. Accordingly, an enrichment layer comprising a continuous matrix composed of a gamma-phase solid solution of chromium in nickel and a precipitate granularly dispersed in the matrix and composed of a beta-phase intermetallic compound of nickel and the combining element which in this case is aluminum is formed.

The grains of the beta-phase compound dispersed in the matrix serve as a reservoir of aluminum, which may diffuse to the surface of the enrichment layer and form alumina scales with oxygen supplied by exposing the article to suitable oxidizing conditions.

The enrichment layer is formed by a carefully controlled vapor deposition process, wherein chromium is precipitated onto the substrate from a chromium vapor formed distant from and guided subsequently to the substrate, and diffused into the substrate to form the enrichment layer. Aluminum and nickel are provided from the superalloy itself, and aluminum is stored in the enrichment layer in the form of the said intermetallic compound. Besides the beta-phase compound, a gamma-prime-phase compound of nickel and aluminum can form, if suitable conditions are provided. Care must be taken to avoid the occurrence of alpha-phase chromium compounds, which would lead to formation of chromium oxide scales on the surface of the enrichment layer, these chromium oxide scales being clearly inferior to alumina scales in corrosion and oxidation resistant properties. To this end, a maximum concentration of chromium in the enrichment layer is expediently kept below 45% by weight, to keep a safe distance from a limit where a phase transition forming an alpha-phase compound might occur, as explained hereinabove. The vapor deposition process provides the enrichment layer with a concentration gradient of chromium increasing from a minimum value substantially equal to a concentration of chromium in the superalloy at an interface between the substrate and the enrichment layer to the maximum value greater than the minimum value at the surface of the enrichment layer facing away from the substrate.

Naturally, further chemical elements must be expected in the enrichment layer, since the enrichment layer is partly composed of the superalloy which as a rule contains a multiplicity of elements besides nickel, aluminum and chromium. In particular, the presence of cobalt in the enrichment layer must be expected.

A gas turbine component can be hollow in order to be cooled from the inside by a suitable cooling medium, in particular compressed air or steam. To afford corrosion and oxidation resistant properties not only to the outer side of the article exposed to a very hot gas stream during service, but also to the inner side, the substrate is covered by the enrichment layer both on the inner side and on the outer side. This two-part enrichment layer is expediently formed within a single chromizing process, wherein chromium is precipitated on the inner side and on the outer side concurrently. On the inner side, the corrosion and oxidation resistant properties of the enrichment layer will generally be sufficient for the service intended; however, an additional protective coating will be placed on the enrichment layer on the outer side. The protective coating comprises a metallic bond coating formed of an alloy of the type MCrAlY as disclosed in U.S. Pat. No. 5,401,307 referred to hereinabove. On the bond coating, a ceramic thermal barrier layer is placed and bonded to the enrichment layer by the bond coating. The thermal barrier layer can be formed of a partly stabilized zirconia, in accordance with usual practice.

EXAMPLE 2

The article to be manufactured is a turbine component, in particular a gas turbine vane. A substrate for this article is shaped of a commercially available cobalt-base superalloy specified as MAR-M509. This superalloy contains chromium, but no combining element. It is not as strong as the nickel-base superalloy mentioned before, but it can be utilized at a markedly higher temperature than that alloy. Accordingly, MAR-M509 is qualified for articles subject to moderate mechanical but extreme thermal stress, as occurs for first-stage vanes in gas turbines.

Again, the article is hollow to provide a cooling channel for a cooling medium as explained. To protect the inner side facing the cooling channel of the article against corrosion and oxidation, this inner side is provided with an enrichment layer. This enrichment layer is formed by forming a vapor comprising chromium by any suitable means, in particular by treating a powdery preparation of a chromium salt and other activating agents at a suitably high temperature to form gaseous chromium. The vapor thus formed is guided into the cooling channel of the article and precipitated onto the inner side of the substrate. Subsequently, the precipitated chromium is diffused into the substrate to form the enrichment layer. The vapor deposition process is applicable to known gas turbine components, even if the cooling channels provided are formed as meanders or other complex forms. The vapor deposition process has excellent controllability which is expediently utilized to avoid formation of alpha-phase chromium compounds. Owing to the absence of a combining element, the enrichment layer will of course form chromium oxide scales when subjected to an oxidizing condition at a suitable temperature. However, protection by chromium oxide will generally be sufficient for a cooling channel, since the temperatures occurring there are generally not excessively high. Excellent durability of the chromium oxide scales is assured owing to the absence of alpha-phase compounds.

To protect the outer side of the article, the article is expediently covered with a special protective coating. This protective coating can comprise a metallic layer formed of an MCrAlY-alloy and a ceramic thermal barrier layer which is anchored to the substrate by the metallic layer, as elaborated for the previous example. This protective coating can be placed directly onto the substrate.

Thus, the invention provides an article of manufacture comprising a substrate composed of a superalloy, and an enrichment layer containing chromium and placed on the substrate, which allows the full potential of superalloys for increasing creep rupture properties to be exploited by decreasing their chromium contents and yet provides means to retain the corrosion and oxidation resistant properties of superalloys characterized by a fairly high chromium content.

We claim:

1. An article of manufacture comprising:

a substrate composed of a superalloy containing chromium in an amount of 6% to 14% by weight and a base element selected from the group consisting of iron, cobalt, and nickel; and an enrichment layer formed by an increasing concentration of chromium in a direction of a surface of the substrate into the inside of the substrate, in which said enrichment layer comprises a continuous matrix composed of a gamma-phase solid solution of chromium in said base element.

2. The article according to claim 1, wherein said base element is nickel.

3. The article according to claim 2, wherein said solid solution further comprises cobalt.

4. An article of manufacture comprising:

a substrate composed of a superalloy containing chromium and a base element selected from the group consisting of iron, cobalt, and nickel; and an enrichment layer formed by an increasing concentration of chromium in a direction of a surface of the substrate into the inside of the substrate, in which said enrichment layer comprises a continuous matrix composed of a gamma-phase solid solution of chromium in said base element, wherein said superalloy contains a combining element which forms a gamma-prime phase intermetallic compound with nickel and an oxide scale when subjected to an oxidizing condition at a high temperature; and said enrichment layer comprises a precipitate granularly dispersed in said matrix and composed of a beta-phase inter-metallic compound of nickel and said combining element.

5. The article according to claim 4, wherein said combining element is selected from the group consisting of aluminum and gallium.

6. The article according to claim 1, wherein said superally contains chromium with a concentration of less than 10% by weight.

7. The article according to claim 4, wherein said enrichment layer comprises a further precipitate granularly dispersed in said matrix and composed of a gamma-prime-phase compound of nickel and said combining element.

8. The article according to claim 1, wherein said base element is cobalt.

9. The article according claim 1, wherein said enrichment layer has a concentration gradient of chromium increasing from a minimum value substantially equal to a concentration of chromium in said superalloy at an interface between said substrate and said enrichment layer to a maximum value greater than said minimum value at a surface of said enrichment layer facing away from said substrate.

10. The article according to claim 9, wherein said maximum value is less than 45% by weight.

11. An article of manufacture comprising:

a substrate composed of a superalloy containing chromium and a base element selected from the group consisting of iron, cobalt, and nickel; and an enrichment layer formed by an increasing concentration of chromium in a direction of a surface of the substrate into the inside of the substrate, in which said enrichment layer comprises a continuous matrix composed of a gamma-phase solid solution of chromium in said base element, wherein said enrichment layer is essentially free of alpha-phase chromium compounds.

12. The article according to claim 1, having a protective coating placed on said enrichment layer.

13. The article according to claim 12, wherein said protective coating comprises a ceramic thermal barrier layer.

14. The article according to claim 12, wherein said protective coating comprises a layer composed of an MCrAlY alloy.

15. The article according claim 1, wherein said substrate is a hollow body having an inner side and an outer side, and said substrate is covered by said enrichment layer both on said inner side and on said outer side.

16. The article according to claim 15, wherein said outer side is covered by a protective coating placed on said enrichment layer.

17. An article of manufacture comprising:

a substrate composed of a superalloy containing chromium and a base element selected from the group consisting of iron, cobalt, and nickel; and an enrichment layer formed by an increasing concentration of chromium in a direction of a surface of the substrate into the inside of the substrate, in which said enrichment layer comprises a continuous matrix composed of a gamma-phase solid solution of chromium in said base element, wherein said substrate is a hollow body having an inner side and an outer side and said substrate is covered by said enrichment layer only on said inner side.

18. The article according to claim 17, wherein said outer side is covered by a protective coating placed on said substrate.

19. The article according to claim 1, wherein said substrate is a gas turbine component.

20. A method of manufacturing an article comprising:

a substrate composed of a superalloy containing chromium in an amount of 6% to 14% by weight and a base element selected from the group consisting of iron, cobalt, and nickel; and an enrichment layer containing chromium and placed on the substrate; wherein the enrichment layer is placed by precipitating chromium onto the substrate and diffusing precipitated chromium into the substrate to form the enrichment layer; in which the precipitated chromium is diffused into the substrate to form the enrichment layer having a continuous matrix composed of a gamma-phase solid solution of chromium in the base element.

21. The method according to claim 20, wherein the superalloy contains cobalt as the base element.

22. A method of manufacturing an article comprising:

a substrate composed of a superalloy containing chromium and a base element selected from the group consisting of iron, cobalt, and nickel; and an enrichment layer containing chromium and placed on the substrate;

wherein the enrichment layer is placed by precipitating chromium onto the substrate and diffusing precipitated chromium into the substrate to form the enrichment layer; in which the precipitated chromium is diffused into the substrate to form the enrichment layer having a continuous matrix composed of a gamma-phase solid solution of chromium in the base element, wherein the substrate is a hollow body having an inner side and an outer side; and the enrichment layer is placed on the substrate only on the inner side.

23. The method according to claim 22, wherein the outer side is covered with a protective coating placed on the substrate.

24. A method of manufacturing an article comprising:

a substrate composed of a superalloy containing chromium, a base element selected from the group consisting of iron, cobalt, and nickel, and a combining element which forms a gamma-prime-phase intermetallic compound with the base element and an oxide scale when subjected to an oxidizing condition at a high temperature; and an enrichment layer containing chromium and placed on the substrate; wherein:

the enrichment layer is placed by precipitating chromium onto the substrate, diffusing precipitated chromium into the substrate to form the enrichment layer and diffusing the combining element from the substrate into the enrichment layer, in which the precipitated chromium is diffused into the substrate to form the enrichment layer comprising a continuous matrix composed of a gamma-phase solid solution of chromium in the base element; and the combining element is diffused into the enrichment layer to form a precipitate granularly dispersed in the matrix and composed of a beta-phase intermetallic compound of the base element and the combining element.

25. The method according to claim 24, wherein the substrate contains nickel as the base element.

26. The method according to claim 24, wherein the substrate contains chromium with a concentration of chromium of less than 14% by weight.

27. The method according to claim 26, wherein the substrate contains chromium with a concentration of chromium of less than 10% by weight.

28. The method according to claim 24, wherein:

the substrate is a hollow body having an inner side and an outer side; and the enrichment layer is placed on the substrate both on the inner side and on the outer side.

29. The method according to claim 28, wherein the outer side is covered with a protective coating placed on the enrichment layer.

30. The method according to claim 24, wherein the combining element is diffused into the enrichment layer by a heat treatment step subsequent to forming the enrichment layer.

31. The method according to claim 20, wherein the enrichment layer is formed having a concentration gradient of chromium increasing from a minimum value substantially equal to a concentration of chromium in the superalloy at an interface between the substrate and the enrichment layer to a maximum value greater than the minimum value at a surface of the enrichment layer facing away from the substrate.

32. The method according to claim 20, wherein the chromium is precipitated onto the substrate by forming a vapor comprising chromium distant from the substrate, guiding the vapor to the substrate and precipitating chromium onto the substrate from the vapor.

* * * * *